US010487380B2

(12) United States Patent
Cha et al.

(10) Patent No.: US 10,487,380 B2
(45) Date of Patent: Nov. 26, 2019

(54) HIGH-STRENGTH SPECIAL STEEL

(71) Applicant: Hyundai Motor Company, Seoul (KR)

(72) Inventors: Sung Chul Cha, Seoul (KR); Yong Bo Sim, Seoul (KR); Seung Hyun Hong, Seoul (KR)

(73) Assignee: Hyundai Motor Company, Seoul (KR)

( * ) Notice: Subject to any disclaimer, the term of this patent is extended or adjusted under 35 U.S.C. 154(b) by 4 days.

(21) Appl. No.: 15/374,789

(22) Filed: Dec. 9, 2016

(65) Prior Publication Data

US 2018/0051364 A1 Feb. 22, 2018

(30) Foreign Application Priority Data

Aug. 17, 2016 (KR) ..... 10-2016-0104352

(51) Int. Cl.

| | |
|---|---|
| ***C22C 38/50*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |

(Continued)

(52) U.S. Cl.

CPC ..... *C22C 38/50* (2013.01); *C22C 38/002* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01)

(58) Field of Classification Search

CPC ..... C22C 38/00; C22C 38/002; C22C 38/02; C22C 38/04; C22C 38/06; C22C 38/54; C22C 38/34; C22C 38/42; C22C 38/44; C22C 38/46; C22C 38/48; C21D 1/00; C21D 1/26; C21D 6/00; C21D 6/001; C21D 6/002; C21D 6/004; C21D 6/005; C21D 6/02; C21D 8/1244; C21D 8/00; C21D 8/005; C21D 8/02; C21D 8/0205; C21D 8/0405; C21D 9/00; C21D 9/46; C21D 2211/00; C21D 2211/004; B21J 1/00; B21J 1/02; B21J 1/06; B21B 45/00; B21C 1/00; B21C 37/00; B21C 37/02

See application file for complete search history.

(56) References Cited

U.S. PATENT DOCUMENTS 4,032,333 A * 6/1977 Josefsson ..... C22C 38/60 420/84

4,796,946 A 1/1989 Wilson (Continued)

FOREIGN PATENT DOCUMENTS

EP 0 943 697 A1 9/1999

EP 1 096 031 A2 5/2001

(Continued)

*Primary Examiner* — Alexandra M Moore

(74) *Attorney, Agent, or Firm* — Morgan, Lewis & Bockius LLP

(57) ABSTRACT

Disclosed herein is high-strength special steel containing about 0.1 to 0.5 wt % of carbon (C), about 0.1 to 2.3 wt % of silicon (Si), about 0.3 to 1.5 wt % of manganese (Mn), about 1.1 to 4.0 wt % of chromium (Cr), about 0.3 to 1.5 wt % of molybdenum (Mo), about 0.1 to 4.0 wt % of nickel (Ni), about 0.01 to 0.50 wt % of vanadium (V), about 0.05 to 0.50 wt % of titanium (Ti), and the remainder of iron (Fe) and other inevitable impurities.

3 Claims, 4 Drawing Sheets

(51) Int. Cl.

| | |
|---|---|
| ***C22C 38/42*** | (2006.01) |
| ***C22C 38/44*** | (2006.01) |
| ***C22C 38/46*** | (2006.01) |

(56) References Cited

U.S. PATENT DOCUMENTS

| | | | | |
|---|---|---|---|---|
| 4,796,976 | A * | 1/1989 | Leslie | C09K 19/3852 252/299.01 |
| 5,073,338 | A | 12/1991 | Furusawa et al. | |
| 5,749,228 | A | 5/1998 | Shiga et al. | |
| 6,494,970 | B1 | 12/2002 | Ishii et al. | |
| 6,681,692 | B2 | 1/2004 | Beran | |
| 2001/0035235 | A1 | 11/2001 | Kawano | |
| 2007/0224041 | A1 | 9/2007 | Kawanaka et al. | |
| 2009/0092516 | A1* | 4/2009 | Hashimura | C21D 9/52 420/110 |
| 2009/0291013 | A1* | 11/2009 | Fedchun | C21D 6/004 420/91 |
| 2011/0079328 | A1* | 4/2011 | Yokoi | C21C 7/0006 148/504 |
| 2012/0009434 | A1* | 1/2012 | Hata | C21D 6/008 428/577 |

FOREIGN PATENT DOCUMENTS

| | | | |
|---|---|---|---|
| EP | 1 698 712 | A1 | 9/2006 |
| JP | 2-50910 | A | 2/1990 |
| JP | 2-250941 | A | 10/1990 |
| JP | 4-358040 | A | 12/1992 |
| JP | 7-150289 | A | 6/1995 |
| JP | 7-276080 | A | 10/1995 |
| JP | 8-60291 | A | 3/1996 |
| JP | H08-134547 | A | 5/1996 |
| JP | 8-209289 | A | 8/1996 |
| JP | 11-229079 | A | 8/1999 |
| JP | 2000-204434 | A | 7/2000 |
| JP | 2001-81531 | A | 3/2001 |
| JP | 4608979 | B2 | 1/2011 |
| JP | 5196934 | B2 | 5/2013 |
| JP | 5200540 | B2 | 6/2013 |
| JP | 2015-528065 | A | 9/2015 |
| JP | 2015-190026 | A | 11/2015 |
| KR | 10-0723186 | B1 | 5/2007 |
| KR | 10-2009-0016746 | A | 2/2009 |
| KR | 10-2014-0044925 | A | 4/2014 |
| KR | 10-2015-0023566 | A | 3/2015 |
| KR | 10-2015-0038426 | A | 4/2015 |
| KR | 10-1612474 | B1 | 4/2016 |
| KR | 10-2016-0096611 | A | 8/2016 |
| WO | WO 2007/074984 | A1 | 7/2007 |
| WO | WO 2013035848 | A1 | 3/2013 |
| WO | WO 2013/182621 | A1 | 12/2013 |
| WO | WO 2014/016420 | A1 | 1/2014 |
| WO | WO 2014/016421 | A1 | 1/2014 |
| WO | WO 2014/157231 | A1 | 10/2014 |
| WO | WO 2015/087224 | A1 | 6/2015 |

* cited by examiner

HIGH-STRENGTH SPECIAL STEEL

CROSS REFERENCE TO RELATED APPLICATION

The present application claims under 35 U.S.C. § 119(a) the benefit of Korean Patent Application No. 10-2016-0104352, filed Aug. 17, 2016, the entire contents of which are incorporated herein by reference for all purposes.

BACKGROUND OF THE INVENTION

Field of the Invention

The present invention relates to high-strength special steel, components thereof, and amounts of which can be adjusted so that the form, size and amount of carbide can be controlled. As such, the high-strength special steel exhibits increasing strength and desirable fatigue life.

Description of the Related Art

For stabilizer bars in chassis modules, drive shafts, or subframes, and arms in chassis suspensions of rally cars, techniques for reducing the weight thereof are being developed to maximize fuel efficiency. In some instances, these parts are manufactured in a hollow form or polymer materials.

In the case of conventional chassis steel, high-strength requirements are satisfied by the addition of elements such as chromium (Cr), molybdenum (Mo) and vanadium (V). However, such steel is problematic because relatively simple carbides are formed within the steel structure. The amount of carbide that is formed is not large and the size thereof is not small, and thus, the durability of the steel parts is compromised.

KR 10-2015-0023566 discloses high-strength steel comprising nickel (Ni), molybdenum (Mo) and titanium (Ti), wherein the amount of nickel (Ni) is merely 0.1 wt % or less and the amount of titanium (Ti) is merely 0.01 wt % or less, thus making it difficult to increase durability while maintaining high strength.

JP 2015-190026 discloses high-strength steel in which the amount of nickel (Ni) is merely in the range of 0.01 to 0.2 wt % and the amount of titanium (Ti) is merely in the range of 0.005 to 0.02 wt %, thus making it difficult to increase durability while maintaining high strength.

Details described as the background art are provided for the purpose of better understanding the background of the invention, but are not to be taken as an admission that the described details correspond to the conventional technology already known to those skilled in the art.

SUMMARY OF THE INVENTION

In one aspect, provided herein is high-strength special steel, which has increased strength and fatigue life through the control of the form, size and amount of carbide by adjusting the components and amounts thereof.

The present invention provides high-strength special steel, comprising from about 0.1 to 0.5 wt % of carbon (C), from about 0.1 to 2.3 wt % of silicon (Si), from about 0.3 to 1.5 wt % of manganese (Mn), from about 1.1 to 4.0 wt % of chromium (Cr), from about 0.3 to 1.5 wt % of molybdenum (Mo), from about 0.1 to 4.0 wt % of nickel (Ni), from about 0.01 to 0.50 wt % of vanadium (V), from about 0.05 to 0.50 wt % of titanium (Ti), and the remainder of iron (Fe) and other inevitable impurities.

In some embodiments, (Ti,V)C in complex carbide form may be present in the steel structure.

In some embodiments, $(Cr,Fe)_7C_3$ in complex carbide form may be present in the steel structure.

In some embodiments, $(Fe,Cr,Mo)_{23}C_6$ in complex carbide form may be present in the steel structure.

The precipitate present in the steel structure may have a mole fraction of about 0.009 or more (e.g., about 0.009, 0.010, 0.020, 0.030, 0.040, 0.050 or more).

The precipitate present in the steel structure may have a size of about 13 nm or less (e.g., about 13 nm, 12, 11, 10, 9, 8, 7, 6, 5, 4, 3, 2, or about 1 nm).

The high-strength special steel may have a tensile strength of about 1541 MPa or more (e.g., about 1541 MPa, 1550, 1600, 1650, 1700, 1750, 1800, 1850, about 1900 MPa or more) and a fatigue life of about 550 thousand times or more (e.g., about 550 thousand times, 560, 570, 580, 590, 600, 610, 650, 700, 750, 800, 850, 900, or about 950 thousand times or more).

According to the present invention, high-strength special steel can be enhanced in strength and fatigue life in a manner in which the amounts of elements are controlled to thus form carbides in the steel structure.

BRIEF DESCRIPTION OF THE DRAWINGS

The above and other features and advantages of the present invention will be more clearly understood from the following detailed description taken in conjunction with the accompanying drawings.

DESCRIPTION OF SPECIFIC EMBODIMENTS

Figure 1:
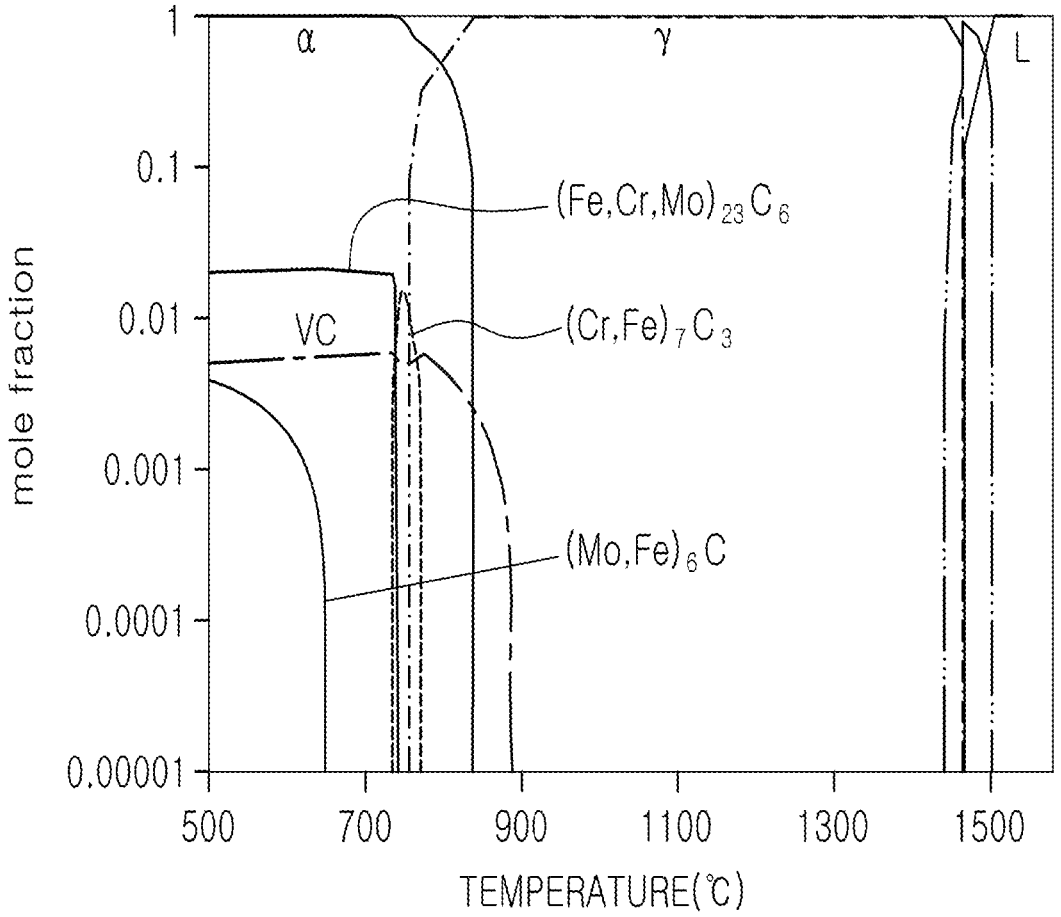
FIG. 1 is a graph showing changes in mole fraction depending on temperature in phases of conventional steel.

Hereinafter, a detailed description will be given of preferred embodiments of the present invention with reference to the appended drawings.

The present invention addresses high-strength special steel, comprising from about 0.1 to about 0.5 wt % (e.g., about 0.1 wt %, 0.2, 0.3, 0.4, or about 0.5 wt %) of carbon (C), from about 0.1 to about 2.3 wt % (e.g., about 0.1 wt %, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2.0, 2.1, 2.2, or about 2.3 wt %) of silicon (Si), from about 0.3 to about 1.5 wt % (e.g., about 0.3 wt %, 0.4, 0.5, 0.6, 0.7, 0.8, 0.9, 1, 1.1, 1.2, 1.3, 1.4, or about 1.5 wt %) of manganese (Mn), from about 1.1 to about 4.0 wt % (e.g., about 1.1 wt %, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0 wt %) of chromium (Cr), from about 0.3 to about 1.5 wt % (e.g., about 0.3 wt %, 0.4, 0.5, 0.6, 0.7, 0.8, 0.9, 1, 1.1, 1.2, 1.3, 1.4, or about 1.5 wt %) of molybdenum (Mo), from about 0.1 to about 4.0 wt % (e.g., about 0.1 wt %, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0 wt %) of nickel (Ni), from about 0.01 to about 0.50 wt % (e.g., about 0.01 wt %, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50 wt %) of vanadium (V), from about 0.05 to about 0.50 wt % (e.g., about 0.05 wt %, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50 wt %) of titanium (Ti), and the remainder of iron (Fe) and other inevitable impurities.

In the high-strength special steel according to the present invention, the reasons for necessarily limiting the amounts of components thereof are given below, in which % indicates wt % unless otherwise stated.

Carbon (C): from about 0.1% to about 0.5%

Carbon (C) functions to increase strength and hardness and to stabilize residual austenite, and forms complex carbides such as (Ti,V)C, $(Cr,Fe)_7C_3$, and $(Fe,Cr,Mo)_{23}C_6$. Also, tempering resistance is increased up to about 300° C.

If the amount of carbon (C) is less than 0.1 wt %, the effect of increasing strength is not significant, and fatigue strength may decrease. On the other hand, if the amount of carbon (C) exceeds 0.5%, large carbides, which are not dissolved, may be left behind, undesirably deteriorating fatigue characteristics and decreasing durability life. Furthermore, processability before quenching may decrease. Hence, the amount of carbon (C) is limited to the range of 0.1 to 0.5% (e.g., about 0.1%, 0.2, 0.3, 0.4, or about 0.5%).

Silicon (Si): from about 0.1% to about 2.3%

Silicon (Si) functions to increase elongation and also to harden ferrite and martensite structures and increase heat resistance and hardenability. It may increase shape invariance and heat resistance but is susceptible to decarburization.

If the amount of silicon (Si) is less than 0.1%, the effect of increasing elongation becomes insignificant. Furthermore, the effect of increasing heat resistance and hardenability is not significant. On the other hand, if the amount of silicon (Si) exceeds 2.3%, decarburization may occur due to bidirectional infiltration between the steel structure and carbon (C). Furthermore, processability may decrease due to an increase in hardness before quenching. Hence, the amount of silicon (Si) is limited to the range of from about 0.1% to 2.3% (e.g., about 0.1%, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2.0, 2.1, 2.2, or about 2.3%).

Manganese (Mn): from about 0.3% to about 1.5%

Manganese (Mn) functions to enhance hardenability and strength. It may form a solid solution in a matrix to thus increase bending fatigue strength and quenchability, and may act as a deoxidizer for producing an oxide to thus suppress the formation of inclusions such as $Al_2O_3$. If an excess of Mn is contained, MnS inclusions may be formed, leading to high-temperature brittleness.

If the amount of manganese (Mn) is less than 0.3%, the increase in quenchability becomes insignificant. On the other hand, if the amount of manganese (Mn) exceeds 1.5%, processability before quenching may decrease and fatigue life may be decreased due to the center segregation and the precipitation of MnS inclusions. Hence, the amount of manganese (Mn) is limited to the range of from about 0.3% to about 1.5% (e.g., about 0.3%, 0.4, 0.5, 0.6, 0.7, 0.8, 0.9, 1, 1.1, 1.2, 1.3, 1.4, or about 1.5%).

Chromium (Cr): from about 1.1% to about 4.0%

Chromium (Cr) is dissolved in an austenite structure, forms CrC carbide upon tempering, increases hardenability, inhibits softness to thus enhance strength, and contributes to the fineness of grains.

If the amount of chromium (Cr) is less than 1.1%, the effects of increasing strength and hardenability are not significant. On the other hand, if the amount of chromium (Cr) exceeds 4.0%, the production of multiple carbides is inhibited, and the effect resulting from the increased amount thereof is saturated, undesirably increasing costs. Hence, the amount of chromium (Cr) is limited to the range of from about 1.1% to about 4.0% (e.g., about 1.1 wt %, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0 wt %).

Molybdenum (Mo): from about 0.3 to about 1.5%

Molybdenum (Mo) forms fine precipitates to thus enhance strength and increases heat resistance and fracture toughness. Also tempering resistance is increased.

If the amount of molybdenum (Mo) is less than 0.3%, the effects of increasing strength and fracture toughness are not significant. On the other hand, if the amount of molybdenum (Mo) exceeds 1.5%, the effect of increasing strength resulting from the increased amount thereof is saturated, undesirably increasing costs. Hence, the amount of molybdenum (Mo) is limited to the range of from about 0.3% to about 1.5% (e.g., about 0.3%, 0.4, 0.5, 0.6, 0.7, 0.8, 0.9, 1, 1.1, 1.2, 1.3, 1.4, or about 1.5%).

Nickel (Ni): from about 0.1% to about 4.0%

Nickel (Ni) functions to increase corrosion resistance, heat resistance, and hardenability and to prevent low-temperature brittleness. It stabilizes austenite and expands the high temperature range.

If the amount of nickel (Ni) is less than 0.1%, the effects of increasing corrosion resistance and high-temperature stability are not significant. On the other hand, if the amount of nickel (Ni) exceeds 4.0%, red brittleness may occur. Hence, the amount of nickel (Ni) is limited to the range of 0.1 to 4.0% (e.g., about 0.1%, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or about 4.0%).

Vanadium (V): from about 0.01% to about 0.50%

Vanadium (V) functions to increase fracture toughness due to the formation of fine precipitates. Such fine precipitates inhibit the movement of grain boundaries. Vanadium (V) is dissolved and undergoes solid solution upon austenization, and is precipitated upon tempering to thus generate secondary hardening. In the case where excess vanadium is added, hardness after quenching is decreased.

If the amount of vanadium (V) is less than 0.01%, the effects of increasing strength and fracture toughness are not significant. On the other hand, if the amount of vanadium (V) exceeds 0.50%, processability may decrease, undesirably resulting in lowered productivity. Hence, the amount of vanadium (V) is limited to the range of 0.01 to 0.50% (e.g., about 0.01%, 0.02, 0.03, 0.04, 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50%).

Titanium (Ti): from about 0.05% to about 0.50%

Titanium (Ti) functions to increase strength due to the formation of fine precipitates, and also to enhance fracture toughness. Furthermore, titanium may act as a deoxidizer to thus form $Ti_2O_3$, replacing the formation of $Al_2O_3$.

If the amount of titanium (Ti) is less than 0.05%, coarsening may occur, and thus the effect of replacing the formation of $Al_2O_3$, which is the main cause of decreased fatigue, is not significant. If the amount of titanium (Ti) exceeds 0.50%, the effect resulting from the increased amount thereof is saturated, undesirably increasing costs. Hence, the amount of titanium (Ti) is limited to the range of from about 0.05% to 0.50% (e.g., about 0.05%, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, or about 0.50%).

In addition to the aforementioned elements, inevitable impurities, for example, aluminum (Al), copper (Cu), and oxygen (O), may be contained.

Aluminum (Al): from about 0.003% or less

Aluminum (Al) functions to increase strength and impact toughness, and also enables expensive elements, such as vanadium for decreasing the size of grains and nickel for ensuring toughness, to be added in decreased amounts. If the amount of aluminum (Al) exceeds 0.003%, a rectangular-shaped large inclusion $Al_2O_3$ may be formed and may thus act as a fatigue site, undesirably deteriorating durability. Hence, the amount of aluminum (Al) is limited to 0.003% or less (e.g., about 0.003%, 0.002%, 0.001% or less).

Copper (Cu): from about 0.3% or less

Copper (Cu) functions to increase strength after tempering and to increase the corrosion resistance of steel, like nickel (Ni). If the amount of copper (Cu) exceeds 0.3%, alloying costs may increase. Hence, the amount of copper (Cu) is limited to 0.3% or less (e.g., about 0.3%, 0.2%, 0.1%, or less).

Oxygen (O): 0.003% or less

Oxygen (O) is coupled with silicon (Si) or aluminum (Al) to thus form a hard oxide-based nonmetal inclusion, undesirably deteriorating fatigue life characteristics. The amount of oxygen (O) is preferably maintained as low as possible. If the amount of oxygen (O) exceeds 0.003%, $Al_2O_3$ may be formed due to the reaction with aluminum (Al) and may act as a fatigue site, thus deteriorating durability. Hence, the amount of oxygen (O) is limited to 0.003% or less (e.g., about 0.003%, 0.002%, 0.001% or less).

EXAMPLES AND COMPARATIVE EXAMPLES

Steel samples of Examples and Comparative Examples were manufactured using the components in the amounts shown in Table 1 below, and the properties thereof are shown in Table 2 below. Upon annealing, samples subjected to oil quenching at 950 to 1000° C. and then tempering at about 200° C. were used.

TABLE 1

| wt % | C | Si | Mn | Cr | Mo | Ni | V | Ti | Cu | Al | O |
|---|---|---|---|---|---|---|---|---|---|---|---|
| Ex. 1 | 0.3 | 0.2 | 0.7 | 1.5 | 0.5 | 2.0 | 0.15 | 0.25 | 0.054 | 0.0004 | 0.0002 |
| Ex. 2 | 0.12 | 0.12 | 0.31 | 1.11 | 0.32 | 0.13 | 0.02 | 0.07 | 0.067 | 0.0005 | 0.0018 |
| Ex. 3 | 0.48 | 2.28 | 1.46 | 3.92 | 1.48 | 3.92 | 0.47 | 0.46 | 0.035 | 0.0011 | 0.0005 |
| Conventional steel | 0.15 | 0.15 | 1.0 | 1.5 | 0.9 | — | 0.25 | — | 0.053 | 0.0023 | 0.0018 |
| C. Ex. 1 | 0.08 | 0.22 | 0.78 | 1.52 | 0.56 | 1.95 | 0.27 | 0.26 | 0.042 | 0.0006 | 0.0004 |
| C. Ex. 2 | 0.52 | 0.19 | 0.36 | 2.14 | 0.39 | 0.33 | 0.32 | 0.08 | 0.040 | 0.001 | 0.002 |
| C. Ex. 3 | 0.32 | 0.09 | 1.47 | 3.79 | 1.38 | 3.32 | 0.47 | 0.41 | 0.050 | 0.002 | 0.001 |
| C. Ex. 4 | 0.15 | 2.32 | 0.83 | 1.55 | 0.62 | 2.52 | 0.16 | 0.34 | 0.034 | 0.0008 | 0.0016 |
| C. Ex. 5 | 0.48 | 0.23 | 0.27 | 2.56 | 0.45 | 0.48 | 0.43 | 0.15 | 0.040 | 0.0009 | 0.0001 |
| C. Ex. 6 | 0.33 | 0.58 | 1.53 | 3.90 | 1.47 | 3.74 | 0.41 | 0.41 | 0.053 | 0.0011 | 0.0016 |
| C. Ex. 7 | 0.21 | 1.92 | 0.92 | 1.08 | 0.65 | 2.37 | 0.19 | 0.35 | 0.065 | 0.0018 | 0.0017 |
| C. Ex. 8 | 0.48 | 0.26 | 0.42 | 4.1 | 1.41 | 0.86 | 0.13 | 0.22 | 0.042 | 0.0005 | 0.001 |
| C. Ex. 9 | 0.31 | 0.39 | 1.47 | 3.56 | 0.27 | 3.88 | 0.47 | 0.46 | 0.044 | 0.0004 | 0.0015 |
| C. Ex. 10 | 0.16 | 1.77 | 1.21 | 1.13 | 1.53 | 2.67 | 0.21 | 0.25 | 0.051 | 0.002 | 0.0023 |
| C. Ex. 11 | 0.48 | 0.24 | 0.54 | 3.91 | 0.59 | 0.07 | 0.37 | 0.11 | 0.061 | 0.001 | 0.0016 |
| C. Ex. 12 | 0.36 | 1.25 | 1.45 | 1.53 | 0.44 | 4.10 | 0.49 | 0.46 | 0.041 | 0.0016 | 0.0002 |
| C. Ex. 13 | 0.13 | 1.38 | 0.96 | 2.33 | 1.26 | 1.45 | 0.009 | 0.23 | 0.063 | 0.0017 | 0.0008 |
| C. Ex. 14 | 0.48 | 0.21 | 0.72 | 3.96 | 0.76 | 1.92 | 0.51 | 0.14 | 0.061 | 0.001 | 0.0009 |
| C. Ex. 15 | 0.27 | 1.77 | 1.44 | 3.11 | 0.41 | 3.72 | 0.17 | 0.03 | 0.047 | 0.0015 | 0.0011 |
| C. Ex. 16 | 0.32 | 2.05 | 0.91 | 1.69 | 1.25 | 2.35 | 0.28 | 0.52 | 0.053 | 0.0023 | 0.0018 |

TABLE 2

| | Tensile strength (MPa) | Hardness (HV) | Fatigue strength (MPa) | Fatigue life |
|---|---|---|---|---|
| Ex. 1 | 1552 | 523 | 1161 | 580 thousand times |
| Ex. 2 | 1563 | 519 | 1172 | 550 thousand times |
| Ex. 3 | 1541 | 528 | 1164 | 560 thousand times |
| Conventional steel | 980 | 340 | 686 | 280 thousand times |
| C. Ex. 1 | 1150 | 383 | 862 | 270 thousand times |
| C. Ex. 2 | 1570 | 525 | 1175 | 250 thousand times |
| C. Ex. 3 | 1270 | 421 | 948 | 240 thousand times |
| C. Ex. 4 | 1510 | 499 | 1128 | 290 thousand times |
| C. Ex. 5 | 1352 | 451 | 1009 | 420 thousand times |
| C. Ex. 6 | 1416 | 470 | 1054 | 220 thousand times |
| C. Ex. 7 | 1180 | 393 | 887 | 230 thousand times |
| C. Ex. 8 | 1495 | 495 | 1118 | 350 thousand times |
| C. Ex. 9 | 1310 | 438 | 969 | 320 thousand times |
| C. Ex. 10 | 1515 | 502 | 1150 | 390 thousand times |
| C. Ex. 11 | 1295 | 435 | 814 | 240 thousand times |
| C. Ex. 12 | 1345 | 451 | 824 | 270 thousand times |
| C. Ex. 13 | 1284 | 426 | 989 | 260 thousand times |
| C. Ex. 14 | 1485 | 492 | 1114 | 390 thousand times |

TABLE 2-continued

| | Tensile strength (MPa) | Hardness (HV) | Fatigue strength (MPa) | Fatigue life |
|---|---|---|---|---|
| C. Ex. 15 | 1385 | 459 | 1053 | 290 thousand times |
| C. Ex. 16 | 1505 | 503 | 1162 | 370 thousand times |

Table 1 shows the components and amounts of steel compositions of Examples and Comparative Examples. Also, Table 2 shows tensile strength, hardness, fatigue strength and fatigue life of Examples and Comparative Examples.

Tensile strength and yield strength were measured according to KS B 0802 or ISO 6892, hardness was measured according to KS B 0811 or ISO 1143, and fatigue life was measured according to KS B ISO 1143.

In Comparative Examples 1 and 2, the amount of carbon (C) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than the corresponding range, all of tensile strength, hardness, fatigue strength and fatigue life were inferior to those of Examples. On the other hand, in the case where the amount of the element was greater than the corresponding range, tensile strength, hardness and fatigue strength were higher than those of Examples, but fatigue life was lower than that of Examples.

In Comparative Examples 3 and 4, the amount of silicon (Si) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than the corresponding range, all of tensile strength, hardness, fatigue strength and fatigue life were inferior to those of Examples. On the other hand, in the case where the amount of the element was greater than the corresponding range, tensile strength, hardness and fatigue strength were equal to those of Examples, but fatigue life was lower than that of Examples.

In Comparative Examples 5 and 6, the amount of manganese (Mn) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than or greater than the corresponding range, tensile strength, hardness, fatigue strength and fatigue life were inferior to those of Examples.

In Comparative Examples 7 and 8, the amount of chromium (Cr) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than the corresponding range, all of tensile strength, hardness, fatigue strength and fatigue life were inferior to those of Examples. On the other hand, in the case where the amount of the element was greater than the corresponding range, tensile strength and fatigue strength were equal to those of Examples, but hardness and fatigue life were lower than those of Examples.

In Comparative Examples 9 and 10, the amount of molybdenum (Mo) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than the corresponding range, all of tensile strength, hardness, fatigue strength and fatigue life were inferior to those of Examples. On the other hand, in the case where the amount of the element was greater than the corresponding range, tensile strength, hardness and fatigue strength were equal to those of Examples, but fatigue life was lower than that of Examples.

In Comparative Examples 11 and 12, the amount of nickel (Ni) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than or greater than the corresponding range, tensile strength, hardness, fatigue strength and fatigue life were inferior to those of Examples.

In Comparative Examples 13 and 14, the amount of vanadium (V) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than the corresponding range, all of tensile strength, hardness, fatigue strength and fatigue life were inferior to those of Examples. On the other hand, in the case where the amount of the element was greater than the corresponding range, tensile strength and fatigue strength were equal to those of Examples, but hardness and fatigue life were lower than those of Examples.

In Comparative Examples 15 and 16, the amount of titanium (Ti) was controlled to be less than or greater than the corresponding range of high-strength special steel of Examples according to the present invention, and the amounts of the other components were controlled in the ranges equivalent to the corresponding ranges of the Examples.

As shown in Table 2, in the case where the amount of the element was less than the corresponding range, all of tensile strength, hardness, fatigue strength and fatigue life were inferior to those of Examples. On the other hand, in the case where the amount of the element was greater than the corresponding range, tensile strength and fatigue strength were equal to those of Examples, but hardness and fatigue life were lower than those of the Examples.

With reference to FIGS. 1 to 4, the high-strength special steel of the present invention is described below.

FIG. 1 is a graph showing changes in mole fraction depending on temperature based on the results of thermodynamic calculation in conventional steel comprising 0.15C-0.15Si-1.0Mn-1.5Cr-0.9Mo-0.25V (the numeral before each element indicates the amount by wt %).

Figure 2:
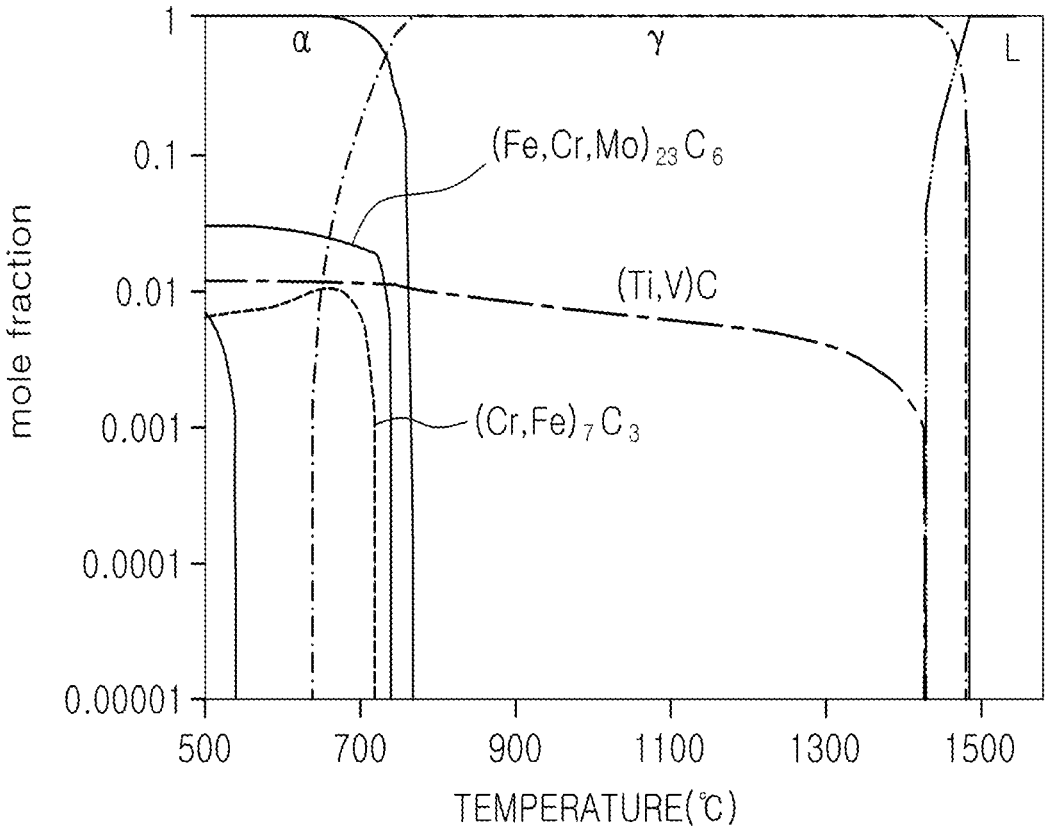
FIG. 2 is a graph showing changes in mole fraction depending on temperature in phases of steel according to the present invention.

FIG. 2 is a graph showing changes in mole fraction depending on temperature based on the results of thermodynamic calculation in the high-strength special steel according to the present invention comprising 0.3C-0.2Si-0.7Mn-1.5Cr-2.0Ni-0.5Mo-0.15V-0.25Ti.

When comparing FIGS. 1 and 2, the steel of the invention contains carbon (C) and an austenite-stabilizing element nickel (Ni) in larger amounts than those of conventional steel, whereby A1 and A3 temperatures are lowered and the austenite region is thus expanded.

Unlike conventional steel having VC carbide in the structure thereof, the steel of the invention is configured such that (Ti,V)C carbide may be precipitated in the structure thereof and thus provided in complex carbide form. This is because titanium (Ti) for forming carbide is added. Unlike conventional steel, the steel of the invention is configured such that (Ti,V)C carbide is produced from the austenite region and thus the size of the carbide is small and the distribution thereof is high. Here, "precipitation" means that another solid phase is newly produced from one solid phase.

As the complex carbide having a small size is uniformly distributed in the steel structure, the strength and fatigue life of the resulting steel may be increased. These results can be seen in Table 2.

Unlike conventional steel in which $(Cr,Fe)_7C_3$ carbide is formed in the structure thereof and then disappears at a temperature equal to or lower than 500° C., the steel of the invention is configured such that $(Cr,Fe)_7C_3$ carbide is precipitated in the structure thereof at a temperature equal to or lower than 500° C. and is thus provided in complex carbide form. The temperature range at which the carbide is stably produced is higher than that of conventional steel, and the carbide having a small size is uniformly distributed in the steel structure, whereby the strength and fatigue life of the resulting steel may be increased. These results can be seen in Table 2.

Unlike conventional steel in which $(Mo,Fe)_6C$ carbide was formed in the structure thereof in a low temperature range, the steel of the invention is configured such that the amount of molybdenum (Mo) is low and thus the carbide such as $(Mo,Fe)_6C$ is not formed in the low temperature range but $(Fe,Cr,Mo)_{23}C_6$ carbide is precipitated and provided in complex carbide form.

The carbide such as $(Mo,Fe)_6C$ formed in the low temperature range is unstable, and thus the strength and fatigue life thereof may be decreased, but a relatively stable complex carbide $(Fe,Cr,Mo)_{23}C_6$ is already formed in a predetermined amount or more at a temperature lower than that at which $(Mo,Fe)_6C$ carbide is formed, thereby inhibiting the formation of $(Mo,Fe)_6C$ carbide due to the lack of molybdenum (Mo), ultimately increasing strength and fatigue life.

Figure 3:
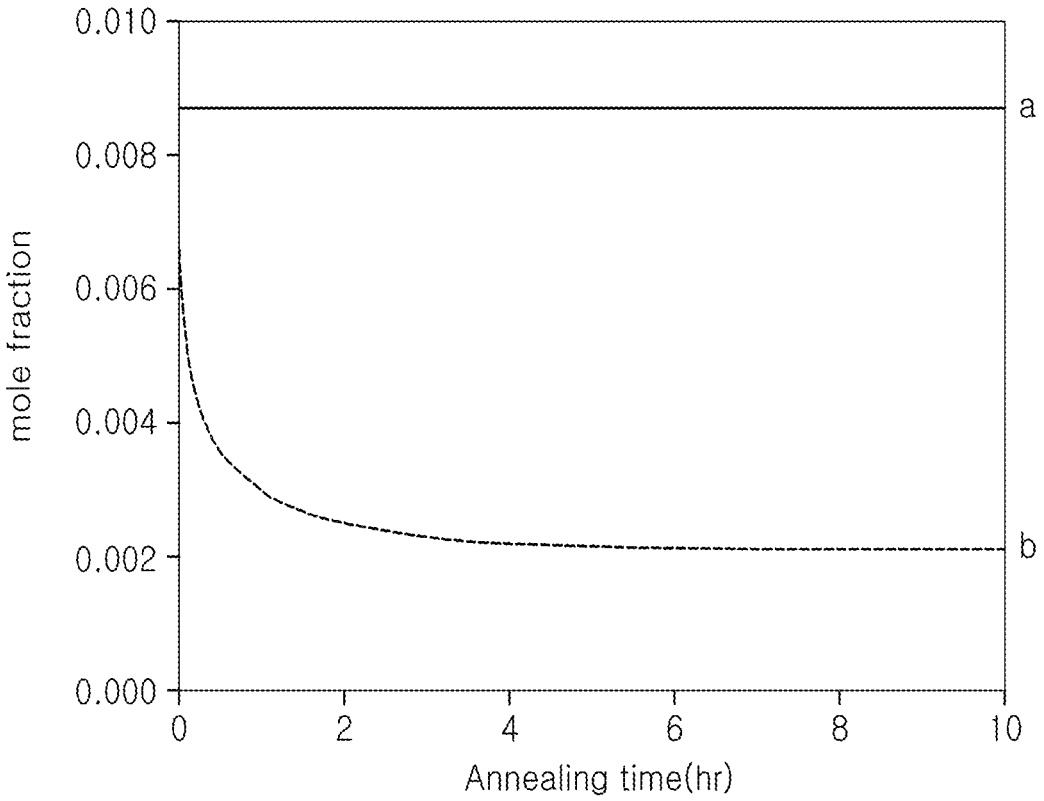
FIG. 3 is a graph showing changes in mole fraction depending on time in the precipitate according to the present invention.

FIG. 3 is a graph showing changes in mole fraction of precipitates including carbides depending on annealing time. In the steel of the invention, a precipitate is formed at a mole fraction of 0.009 or more at the position represented by a, based on an annealing time of 10 hr, and is thus produced in a remarkably large amount, compared to conventional steel having 0.002 at the position represented by b. Thereby, not only strength but also fatigue life may be deemed to be increased. The mole fraction of the precipitate relative to the total structure is represented by 0.9%.

Figure 4:
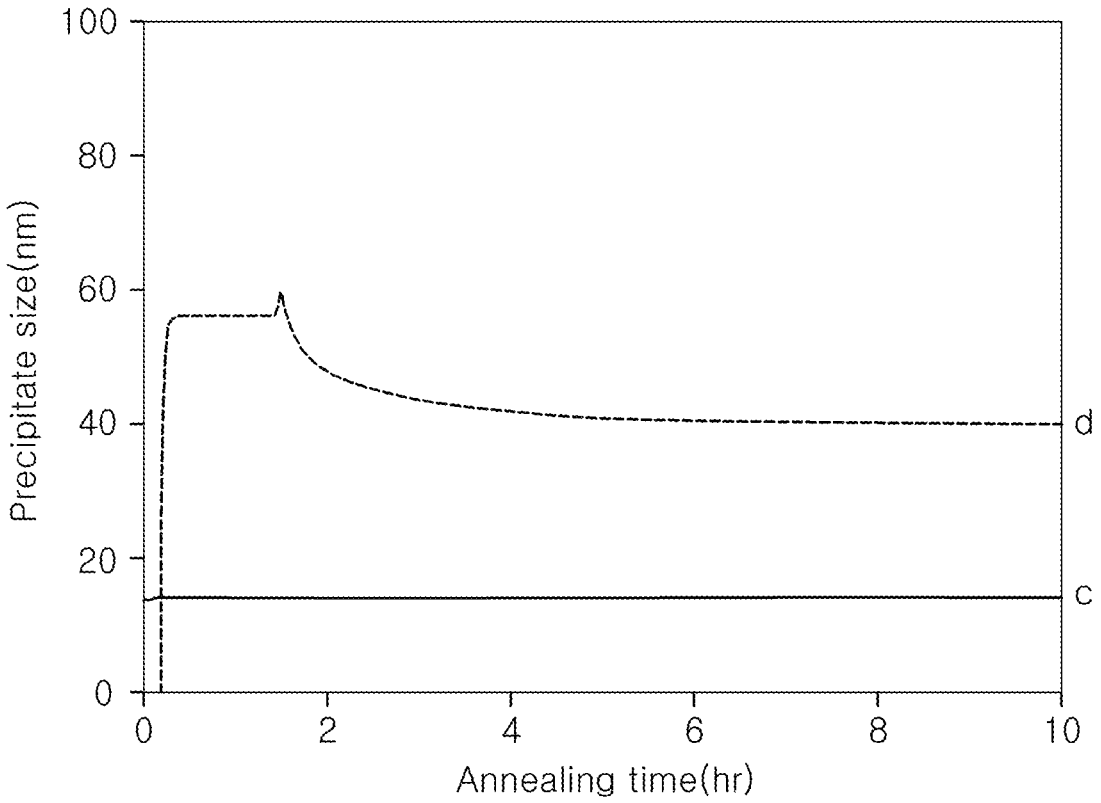
FIG. 4 is a graph showing changes in size depending on time in the precipitate according to the present invention.

FIG. 4 is a graph showing changes in size of precipitates including carbides depending on annealing time. Unlike conventional steel in which a precipitate having a size of 40 nm or more is formed at the position represented by d, based on an annealing time of 10 hr, the steel of the invention can be seen to form a precipitate having a size of 13 nm or less at the position represented by c. Likewise, not only strength but also fatigue life may be increased.

The high-strength special steel according to the present invention can exhibit increased strength and fatigue life through the formation of carbide by controlling the amounts of elements thereof.

Compared to conventional steel, tensile strength can be increased by about 57%, and thus, when the steel of the invention is applied to parts of vehicles, the weight of vehicles can be reduced by about 32%, thereby increasing fuel efficiency. Furthermore, fatigue strength can be increased by about 69% and fatigue life can be increased by about 96%.

Although the preferred embodiments of the present invention have been disclosed for illustrative purposes with reference to the appended drawings, those skilled in the art will appreciate that various modifications, additions and substitutions are possible, without departing from the scope and spirit of the invention as disclosed in the accompanying claims.

What is claimed is:

1. A high-strength special steel, comprising about 0.1 to about 0.5 wt % of carbon (C), about 0.1 to about 2.3 wt % of silicon (Si), about 0.3 to about 1.5 wt % of manganese (Mn), about 1.1 to about 4.0 wt % of chromium (Cr), about 0.3 to about 1.5 wt % of molybdenum (Mo), about 0.1 to about 4.0 wt % of nickel (Ni), about 0.01 to about 0.50 wt % of vanadium (V), about 0.05 to about 0.50 wt % of titanium (Ti), about 0.0002 to about 0.003 wt % of oxygen (O), 0.0004 to about 0.003 wt % of aluminum (Al), and a remainder of iron (Fe) and other inevitable impurities; wherein (Ti,V)C complex carbide, $(Cr,Fe)_7C_3$ complex carbide, and $(Fe,Cr,Mo)_{23}C_6$ complex carbide form in the microstructure of the steel, and wherein the steel has a tensile strength of about 1541 MPa or more and a fatigue life of about 550 thousand times or more.

2. The high-strength special steel of claim 1, wherein a precipitate present in the steel structure has a mole fraction of about 0.009 or more.

3. The high-strength special steel of claim 2, wherein the precipitate present in the steel structure has a size of about 13 nm or less.

* * * * *